US007311111B2

(12) United States Patent
Stanec

(10) Patent No.: US 7,311,111 B2
(45) Date of Patent: Dec. 25, 2007

(54) CONNECTOR FOR CANE HANDLE

(76) Inventor: George Stanec, 15 Secor Rd., Scarsdale, NY (US) 10583

( * ) Notice: Subject to any disclaimer, the term of this patent is extended or adjusted under 35 U.S.C. 154(b) by 0 days.

(21) Appl. No.: 11/230,783

(22) Filed: Sep. 20, 2005

(65) Prior Publication Data

US 2006/0011230 A1 Jan. 19, 2006

Related U.S. Application Data

(63) Continuation of application No. 10/265,567, filed on Oct. 3, 2002, now abandoned.

(51) Int. Cl.
*A45B 9/02* (2006.01)
*A61H 3/02* (2006.01)

(52) U.S. Cl. ..... 135/65; 135/72; 280/821

(58) Field of Classification Search ..... 135/65, 135/71–72, 76, 911; 280/819–824; 81/20–22, 81/27

See application file for complete search history.

(56) References Cited

U.S. PATENT DOCUMENTS

| | | | | |
|---|---|---|---|---|
| 2,241,481 | A | 5/1941 | Schroeder | 135/69 |
| 3,272,210 | A | 9/1966 | Boruvka | 135/69 |
| D290,784 | S | 7/1987 | Moshiri | D3/7 |
| 5,482,070 | A | 1/1996 | Kelly | 135/66 |
| 5,558,621 | A | 9/1996 | Heil | 600/226 |
| 5,727,584 | A | 3/1998 | Stanec | 135/77 |
| 5,755,245 | A | 5/1998 | Van Helvoort | 135/70 |
| 6,516,821 | B1 | 2/2003 | Uemura | 135/75 |

FOREIGN PATENT DOCUMENTS

| | | |
|---|---|---|
| GB | 2354939 | 11/2001 |
| JP | 6-253915 | 9/1994 |
| JP | 7-322908 | 12/1995 |
| JP | 9-108014 | 4/1997 |
| JP | 10-99112 | 4/1998 |
| JP | 10-127324 | 5/1998 |
| JP | 2002065326 A * | 3/2002 |

OTHER PUBLICATIONS

Advertisements from TiagraCanes.com, Jul. 2, 2002.*
Advertisements from Walkingcanedepot.com.*
Advertisements from Autofold.com.*
Advertisements from Walkingequipment.com.*

* cited by examiner

*Primary Examiner*—Winnie Yip
(74) *Attorney, Agent, or Firm*—Ostrolenk, Faber, Gerb & Soffen, LLP

(57) ABSTRACT

A cane having a horizontal handle and a shaft extending down from the handle. A connector between the underside of the handle and the shaft is narrowed below the handle to a small cross-section and is of sufficient length that a user's fingers can straddle the connector with comfort and without the connector urging the fingers outwardly. The connector is of a strong material, such as titanium.

15 Claims, 2 Drawing Sheets

CONNECTOR FOR CANE HANDLE

CROSS-REFERENCE TO RELATED APPLICATION

This is a continuation of U.S. patent application Ser. No. 10/265,567, filed Oct. 3, 2002 now abandoned in the name of George Stanec entitled CONNECTOR FOR CANE HANDLE.

BACKGROUND OF THE INVENTION

The present invention concerns a connector between the handle and shaft of a cane which connector is both shaped for user comfort and is of such material and strength as to provide support without the connector bending.

Canes and particularly walking canes are generally comprised of a shaft and a handle, and the shaft is connected with the handle either directly or through an intermediate connector. The inventor hereof has designed canes including that shown in U.S. Pat. No. 5,727,584 which shows a shaft and a handle wherein the handle is directly connected with the shaft. The cane handle and shaft are shaped in various known arrangements. Well known of course and not relevant to the invention are standard canes with a curved over, crook handle at the top end and which is an integral part of the cane shaft. Some canes or walking sticks have no handle at all or are entirely of a straight shaft.

The invention is concerned with a handle that extends generally horizontally, transverse to the shaft of the cane. The user wraps the horizontal handle with four fingers and with the thumb wrapping around the handle in the other direction. The shaft of the cane can meet the handle either midway along the horizontal extension of the handle or more toward one end. For typical canes that have the shaft meeting the handle approximately midway along the length of the handle, when the handle is correctly grasped, the shaft or a connector to the shaft naturally is lodged between the third and fourth fingers. For other typical canes, where the connection of the shaft to the handle is further toward one end of the handle, when the handle is correctly grasped, the shaft or connector is lodged between the second and third fingers. The invention is concerned with shaping the connection between the handle and the shaft, which connection is grasped between either the second and third or the third and fourth fingers, to be sized for not forcing the adjacent fingers of the user apart, to be comfortable, and yet which is strong enough so as to not break or bend under the full weight of a user applied to the handle or during normal use due to bending moments and impact in use.

Canes are known where the region between the shaft and the handle is somewhat narrowed in cross section for various reasons, but not to the extent of and not with the shape of the present invention. That region may be narrowed because the handle includes a downwardly projecting connector which is telescoped into the greater diameter shaft, or as shown in U.S. Pat. DES. 290,784, the shaft may be narrowed a distance down from the handle to give the shaft an interesting profile. Other examples of narrowed shafts appear in the prior art including U.S. Pat. No. 5,755,245 and in published literature on available canes.

SUMMARY OF THE INVENTION

According to the invention, there is a connector between the cane handle, which extends generally horizontally, and the shaft of the cane. The connector is located along the horizontal extension of the cane for the connector to fit either between the second and third fingers, which is off the center of the handle, or between the third and fourth fingers, which is more toward the center of the length of the handle. The connector may be integrated with the handle and project down from it, or the connector may be integral with the shaft and extend into the handle, or for aesthetic or cost reasons, the connector may be a separate piece installed on the upper end of the shaft and installed in the handle.

The connector is narrow in width in its dimension measured along the length of the handle. In its preferred form, the handle is small in cross-section which also makes it of narrow width. As the connector is of small cross-section for user comfort, in order for the connector to have adequate strength, it must be of strong enough material so that although it is relatively smaller than the shaft in cross-section, the connector must withstand the forces applied during use of the cane. The connector may be of relatively expensive metal or other strong material, such as titanium metal or other non-bendable material. As newer high strength and light weight materials become available, they may be used for the connector. It would be undesirable to increase the expense of the cane by having the entire handle and/or the entire shaft of the cane comprised of expensive material.

When the fingers of the user grip the cane handle and the small cross-section connector is either between the second and third fingers or between the third and fourth fingers, depending upon the cane embodiment, the needle like connector passes between the two fingers and the fingers straddle the connector with minimal restriction on the fingers passing over the connector and with the fingers not being urged outwardly by the connector because the connector width along the handle or its cross-section is small enough.

Other features and advantages of the present invention will become apparent from the following description of the invention which refers to the accompanying drawings.

DETAILED DESCRIPTION OF EMBODIMENTS OF THE INVENTION

Figure 2:
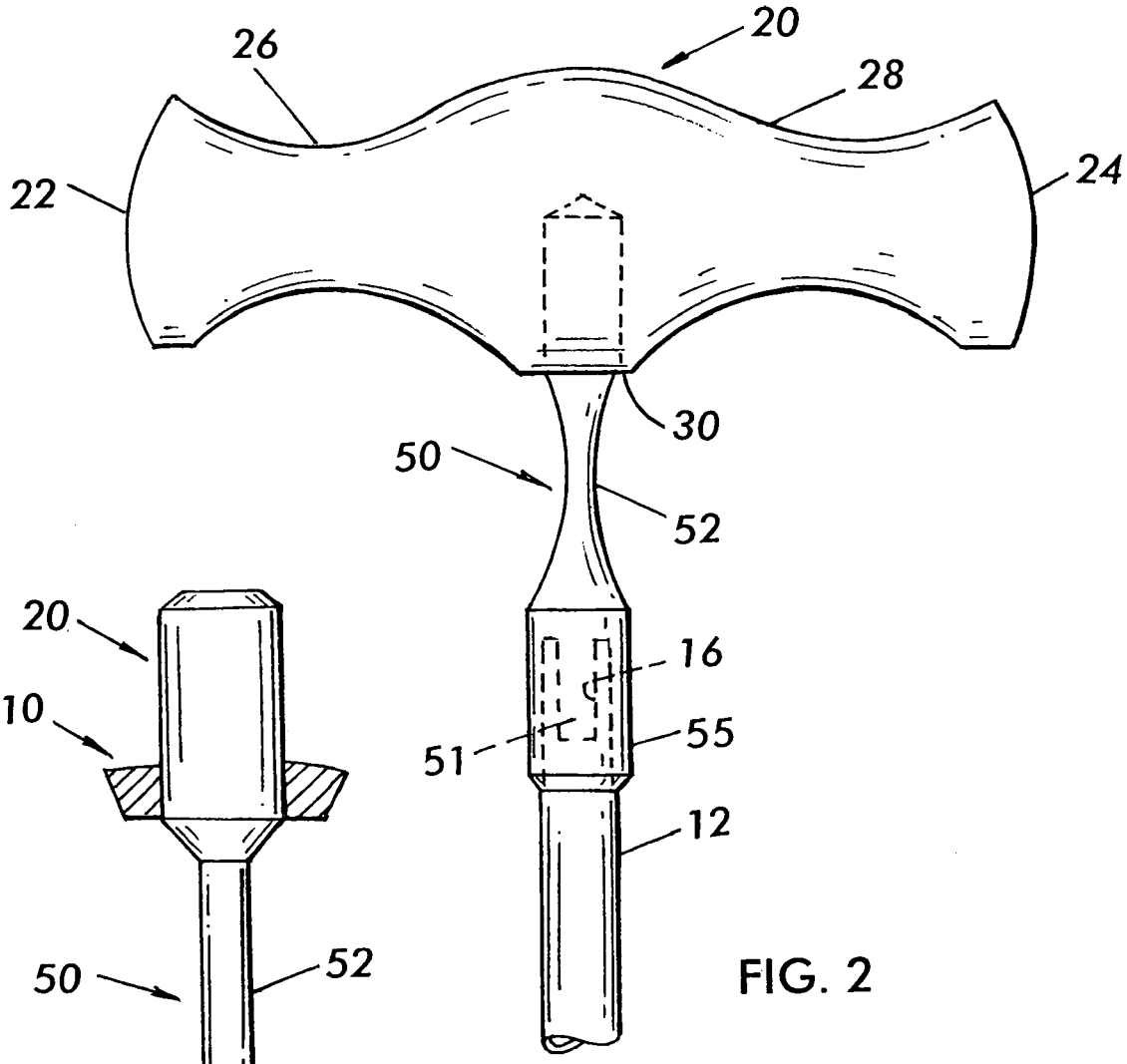
FIG. 2 shows a side view of an upper end of a cane embodiment with a connector between the cane shaft and the handle located midway along the length of a handle.
Figure 1:
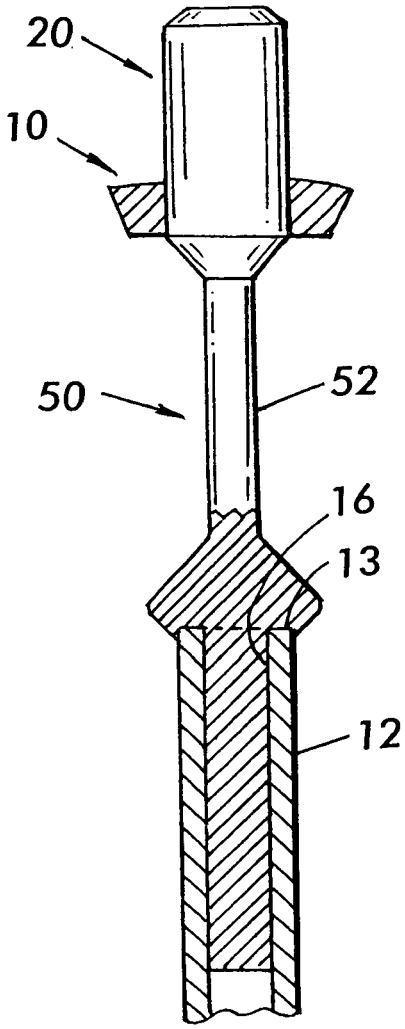
FIG. 1 is a fragmentary end view, partially in cross-section, of an embodiment of a cane according to the invention showing a handle, shaft and a needle-like connector between them according to the invention.

A cane 10 according to the invention includes a conventional shaft 12 of sufficiently sturdy, ornamental material, which may be of wood, a manufactured plastic material, metal or a combination thereof. With reference to the embodiment of FIG. 1, the shaft 12 has an upper end region 13 which has a narrowed diameter opening 16 down from the top thereof defining a hole into which a connector 50 according to the invention is installed in the shaft 12 and a sleeve 55 surrounds the upper end of the shaft 12. FIG. 2 shows an alternate connection between the shaft and the handle. There is a projection 51 from the handle into the shaft opening 16.

Figure 3:
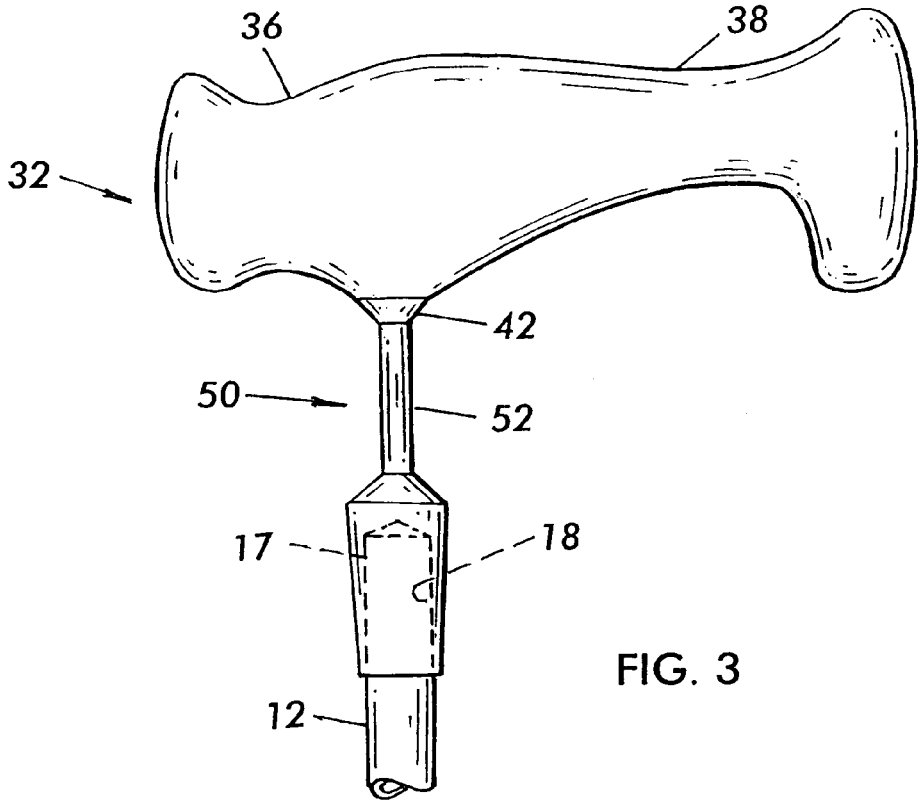
FIG. 3 shows a side view of the upper end of a cane with a connector between the handle and the shaft of the cane located toward one end of the handle.

A handle 20 at the top of the cane is shaped generally with the characteristics of the handle seen either in FIG. 2 or FIG. 3, or is otherwise shaped to provide a comfortable grip and to be aesthetically pleasing. The handle extends horizontally or transversely to the shaft 12. The external profile of the handle is a matter of choice. The connection of the cane shaft 12 to the handle 20 in FIG. 2 is located about midway along the length of the handle 20 between the opposite ends 22, 24 thereof, so that when the handle is gripped, the user would naturally wrap the second and third fingers and the opposing thumb around the front region 26 of the handle 20 and would wrap the fourth and fifth fingers around the rear region 28 of the handle 20.

A hole 30 extends into the underside of the handle 20 in which the upper end of the connector according to the invention is installed. The connector is installed in the connector hole 16 at the end of the shaft 12 and in the hole 30 in the handle 20 by being press fit therein, screw threaded therein or may be held in the holes by a cross-bolt, by using adhesives etc. or in any other way that holds the connector, the handle and the shaft together.

In FIG. 3, in contrast to FIG. 2, the handle is shaped so that the user's thumb and second fingers are intended to be oppositely wrapped around the front region 36 of the handle while the third, fourth and fifth fingers are intended to be wrapped around the rear region 38 of the handle. In contrast to the embodiment of FIG. 2, where the shaft end receives the end of the connector, in FIG. 3 the shaft end 17 is in connector hole 18 into the bottom end of the connector 50 and the underside of the handle 32 has a hole 42 for receiving the connector.

A connector 50 according to the invention has a wide choice of shapes. But the shapes share several characteristics. First, the connector is narrow enough in its width in the direction along the length of the handle, e.g. in its diameter or cross section, that it fits comfortably between the two connector straddling fingers of the hand of the user without tending to spread those fingers apart, whether it be between the third and fourth fingers as in the embodiment in FIG. 2 or the second and third fingers as in the embodiment of FIG. 3. Most important, the connector is narrow with reference to the thicknesses of the handle and the thickness of the shaft of the cane. The preferred embodiments of the connector 50 have a needle like region at 52 just below the handle, so that the fingers can straddle the needle like region 52. The needle diameter, the length and the shape or profile are selected to support the weight of the user and to resist the effect of impacts and to provide user comfort without urging the user's needle straddling fingers apart. The needle diameter may be from 4 millimeters to 7.5 millimeters at the maximum. A diameter greater than 7.5 millimeters typically may interfere with the fingers straddling the connector and may cause them to spread apart, which is what the invention is intended to avoid.

Secondly, the connector is of sufficient length that the straddling fingers can be easily placed along the connector without being spread apart by the profile of the connector at or below the fingers. The length of the needle like part 52 is from 16 millimeters to 24 millimeters. To shorten the needle like part below the minimum length restricts its intended function and may either pinch the user's straddling fingers or urge them apart. The dimensions for the connector are based on a connector made from titanium.

Figure 4:
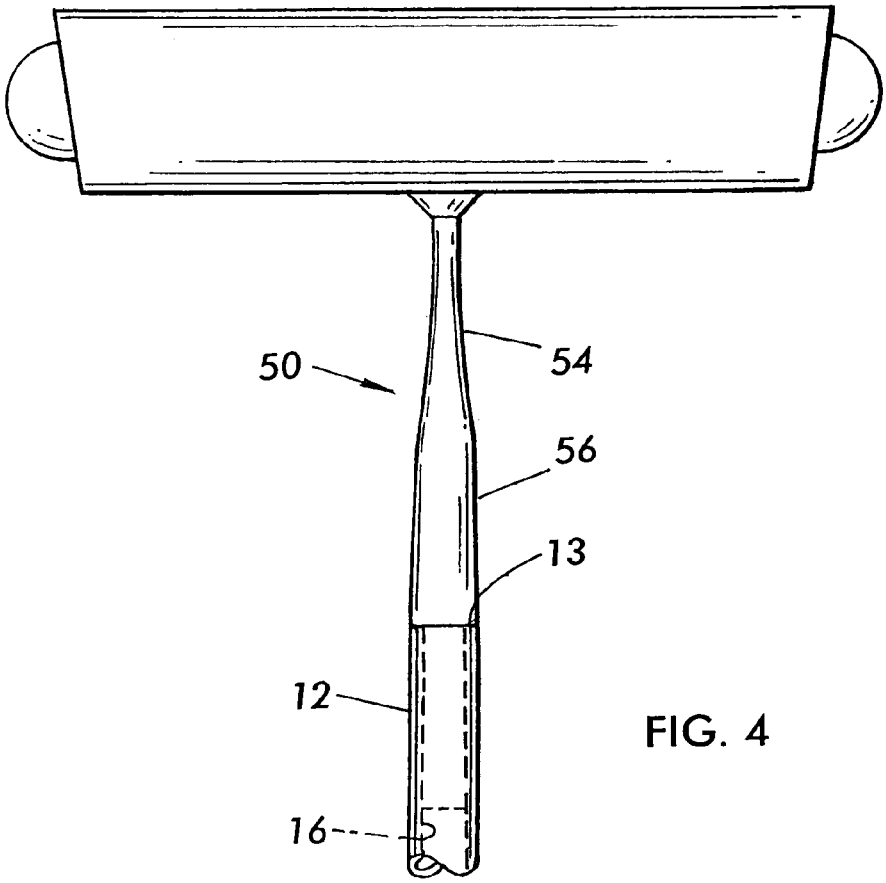
FIG. 4 shows a side view of the upper end of another embodiment.

The shape of the connector, both in its cross section and along its length, is a matter of choice and may be selected for aesthetic reasons, so long as the connector has the required strength and enables the desired user comfort. FIG. 4 illustrates another shape connector 50 with a gradual shape transition from its upper needle shape section 54 toward its thicker region 56 toward the shaft 12.

Typical materials of which cane shafts are comprised, such as wood, plastic, aluminum or steel, etc. may bend, buckle or break under the full weight of the user applied to the handle or at the impact on a cane normally banged against the ground as the user moves the cane. Hence, the material of the connector must be sufficiently strong to withstand these normal bending moments and impacts applied to it.

The relationship between the diameter or thickness and length of the needle is dependent also in part on the strength of the connector and particularly the connector needle like part. But the maximum diameter and minimum length of the needle like part are criteria for assuring user comfort, regardless of the selected material. The sizing of the needle like part suggested herein is based upon using standard grade titanium as the connector. Other strong materials may be used which are strong enough to not bend under the user's weight and the impact to which a cane is normally subjected. As new materials and metal alloys become available, they may be used for the connector. Their characteristics would preferably be of high strength and light weight.

As illustrated herein, the connector between the handle and the shaft of the cane is a separate element, and the connector is installed in the shaft of the cane. This is preferred for aesthetic reasons since the needle like connector is likely to be less aesthetically pleasant in appearance than the handle which is often ornamental, and the shaft of the cane, which is often also ornamental. Further, since the connector and particularly its needle like part must be strong, the connector may also be of relatively expensive material, so that having it as a separate element reduces the overall cost of the materials of the cane. However, the connector may be comprised of the same material as and integrated in one piece with the shaft of the cane or with the bottom of the handle the connector. The connector would then be installed in the other of the handle or the cane shaft of which the connector is not originally an integral part. This might require that the connector be of the same material as the handle or the shaft of which it is an integral part, which would likely increase the cost of the cane but decrease the number of its parts.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A cane comprising a handle to be grasped by a user, a shaft to extend to the ground and a connector being a separate element connected between the handle and the shaft;

the handle having an underside; the connector being at the handle underside;

the connector including a needle part below the underside of the handle, the needle part being so placed and sized that it is adapted to be grasped between the index and the middle fingers or between the middle and the ring fingers of the user's hand without the user's straddling fingers being urged apart by the connector, wherein the connector needle part has a diameter in the range of 4 millimeters to 7.5 millimeters.

2. The cane of claim 1, wherein the connector needle part has a length in the range of 16 millimeters to 24 millimeters and is placed below the handle where the straddling fingers may normally engage the needle part.

3. The cane of claim 2, wherein the connector is of a metal for strongly supporting the weight of the user and impact upon the cane.

4. The cane of claim 3, wherein the connector is of titanium metal.

5. The cane of claim 4, wherein the connector is at the underside of the handle at a location so that the needle part of the connector will extend between the index finger and the middle finger of the user's hand when the handle is held normally by the user.

6. The cane of claim 1, wherein the handle extends in a direction transverse to the shaft and the connector at the underside of the handle extends to the shaft.

7. The cane of claim 6, wherein the connector is at the underside of the handle at a location approximately midway along the horizontal length of the handle so that the needle part of the connector will extend between the middle finger and the ring finger of the user's hand when the handle is held normally by the user.

8. The cane of claim 1, wherein the connector is a separate element from the handle and from the shaft, and the connector is attached to both the handle and the shaft.

9. The cane of claim 8, wherein the handle includes a hole at the underside for receiving the connector and the shaft includes a hole at the end for receiving the connector, and the connector is fastened in the holes in the handle and the shaft.

10. The cane of claim 1, wherein the connector is a separate element from the shaft and is attached to the shaft.

11. The cane of claim 10, wherein the shaft has a top end with a hole therein into which the connector extends.

12. The cane of claim 10, wherein the connector has a bottom end with hole therein into which the shaft extends.

13. The cane of claim 10, wherein the connector is of titanium metal.

14. The cane of claim 1, wherein the connector is of a metal for strongly supporting the weight of the user and impact upon the cane.

15. The cane of claim 1, wherein the connector is connected with the handle and the shaft as to not telescope into or onto the handle or the shaft.

* * * * *